US007634836B2

(12) United States Patent
Lee

(10) Patent No.: US 7,634,836 B2
(45) Date of Patent: Dec. 22, 2009

(54) INTAKE NOZZLE AND VACUUM CLEANER HAVING THE SAME

(75) Inventor: Dong Youl Lee, Masan-si (KR)

(73) Assignee: LG Electronics Inc., Seoul (KR)

( * ) Notice: Subject to any disclaimer, the term of this patent is extended or adjusted under 35 U.S.C. 154(b) by 862 days.

(21) Appl. No.: 11/192,265

(22) Filed: Jul. 29, 2005

(65) Prior Publication Data

US 2006/0021188 A1 Feb. 2, 2006

(30) Foreign Application Priority Data

Jul. 30, 2004 (KR) ..... 10-2004-0060412

(51) Int. Cl.
*A47L 9/02* (2006.01)

(52) U.S. Cl. ..... 15/375; 15/419; 15/421

(58) Field of Classification Search ..... 15/375, 15/415.1–421; *A47L 9/02*
See application file for complete search history.

(56) References Cited

U.S. PATENT DOCUMENTS 2,894,274 A 7/1959 Coons
6,018,845 A 2/2000 Sucki et al.
6,123,779 A 9/2000 Conrad

FOREIGN PATENT DOCUMENTS

| | | |
|---|---|---|
| DE | 43 44 596 | 6/1995 |
| JP | 06086744 | 3/1994 |
| JP | 09253010 | 9/1997 |
| RU | 1545345 | 8/2000 |
| WO | WO 01/65991 | 9/2001 |

OTHER PUBLICATIONS

Russian office Action dated Sep. 29, 2006.

*Primary Examiner*—David A Redding
(74) *Attorney, Agent, or Firm*—KED & Associates, LLP

(57) ABSTRACT

An intake nozzle and vacuum cleaner having the same are disclosed, by which an air intake force can be adjusted. The present invention includes a nozzle case, a first air intake port provided to a bottom of the nozzle case to suck an air including dust by an air intake force generated from driving an air intake device, and an intake force adjusting device varying an intake force of the first intake port.

20 Claims, 8 Drawing Sheets

INTAKE NOZZLE AND VACUUM CLEANER HAVING THE SAME

This application claims the benefit of the Korean Patent Application No. P2004-0060412, filed on Jul. 30, 2004, which is hereby incorporated by reference as if fully set forth herein.

BACKGROUND OF THE INVENTION

1. Field of the Invention

The present invention relates to a vacuum cleaner, and more particularly, to an intake nozzle and vacuum cleaner having the same. Although the present invention is suitable for a wide scope of applications, it is particularly suitable for enabling adjustment of dust intake power.

2. Discussion of the Related Art

Generally, a vacuum cleaner is an appliance for cleaning a carpet, a normal room floor and the like. In the vacuum cleaner, polluted air containing particles is sucked by driving an air intake device provided within a cleaner body to generate an air-sucking force, the particles are separated from the polluted air for dust collecting, and the particle-removed air is then discharged to an outside of the cleaner.

The vacuum cleaner consists of a cleaner body (not shown in the drawing) provided with an air intake device (not shown in the drawing) including a motor and a blower and a dust collector (not shown in the drawing) collecting the particles separated from the polluted air, an intake nozzle 10 moving along a bottom to be cleaned to suck the polluted air containing the particles, and a connecting pipe (not shown in the drawing) guiding the air sucked by the intake nozzle to the dist collector of the cleaner body.

Wheels are provided under both sides of the cleaner body to facilitate a motion of the cleaner body. And, the dust collector of the cleaner body includes a cyclon type dust-collecting box or a general filtering type dust-collecting bag.

And, the connecting pipe includes an extension pipe 5 having one end connected to the intake nozzle, a flexible connecting hose having one end connected to the other end of the extension pipe and the other end connected to the cleaner body, and a handle provided to the other end of the extension pipe.

An intake nozzle provided to a general vacuum cleaner according to a related art is explained with reference to FIG. 1 as follows.

Referring to FIG. 1, an intake nozzle 10 according to a related art includes a nozzle case having an upper case (not shown in the drawing) configuring an exterior and a lower case 11 to have an empty space therein and an air intake port 12 provided to a bottom of the nozzle case, i.e., a bottom of the lower case.

Rollers 13 are provided to both front sides of the lower case to smooth a motion of the intake nozzle 10.

An operation of the above-configured related art intake nozzle 10 is explained as follows.

First of all, once is power is applied to the vacuum cleaner to drive the air intake device, dust on a floor is sucked into the intake nozzle 10 together with air via the air intake port 12 by an air intake force generated from the driven air intake device.

And, the air including the dust sucked into the intake nozzle is guided to the dust-collector of the cleaner body via the extension pipe.

In doing so, the dust collector removes the particles from the polluted air having been introduced into the dust collector to discharge the particle-removed air to an outside of the cleaner body.

However, since the above-configured related art intake nozzle of the vacuum cleaner 10 has the constant air intake force to bring about inconvenience for cleaning, the demand for developing an intake nozzle of a vacuum cleaner capable of adjusting the air intake force rises recently.

SUMMARY OF THE INVENTION

Accordingly, the present invention is directed to an intake nozzle and vacuum cleaner having the same that substantially obviate one or more problems due to limitations and disadvantages of the related art.

An object of the present invention is to provide an intake nozzle and vacuum cleaner having the same, by which an air intake force can be adjusted.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an intake nozzle of a vacuum cleaner according to the present invention includes a nozzle case, a first air intake port provided to a bottom of the nozzle case to suck an air including dust by an air intake force generated from driving an air intake device, and an intake force adjusting device varying an intake force of the first intake port.

Preferably, the intake force adjusting device raises the intake force of the first air intake port if the nozzle case is landed on the floor. Preferably, the intake force adjusting device lowers the intake force of the first air intake port if the nozzle case is separated from on the floor.

Preferably, the intake force adjusting device varies the intake force of the first air intake port according to a status of the floor on which the nozzle case is landed.

Preferably, the intake force adjusting device includes an air passage having an external air supply port formed at a sidewall of the air passage wherein an external air introduced via one side of the nozzle case is introduced via the external air supply port and the air introduced via the first air intake port passes through the air passage and a cut-off unit adjusting an opening degree of the external air supply port to adjust a flux of the air passing through the first air intake port.

More preferably, the cut-off unit includes a cut-off plate opening/closing the external air supply port and a lever unit connected to the cut-off plate to adjust the cut-off plate, the lever unit increasing the flux of the air sucked into the first air intake port in case of being pressed by the floor.

More preferably, the lever unit includes a first lever having one side connected to the cut-off plate and the other side rotatably connected to a rotational shaft provided within the nozzle case and a second lever having one side configured to apply a force to the first lever and the other side configured to be pressed by the floor by being projected beneath the nozzle case.

More preferably, the first lever is elastically supported by a first spring and returns the cut-off plate in a direction of opening the external air supply port.

More preferably, a prescribed position between both ends of the second lever is rotatably connected to a lower part of the nozzle case.

More preferably, a display window is provided to a topside of the nozzle case to check out the opening degree of the external air supply port.

More preferably, the second lever moves the cut-off plate connected to the first lever to a position in the vicinity of the external air supply port.

More preferably, the cut-off plate completely cuts off the external air supply port by an intake force within the chamber at the position in the vicinity of the external air supply port.

More preferably, the intake force adjusting device further includes an auxiliary air passage guiding the external air to an inside of the air passage and a passage opening/closing portion selectively opening the auxiliary air passage to prevent the air passage form being blocked.

More preferably, the passage opening/closing portion includes an elastic member opened/closed by a difference between a pressure within the chamber and an atmospheric pressure outside the nozzle case.

In another aspect of the present invention, a vacuum cleaner includes a cleaner body provided with a dust collector collecting dust by separating dust and an intake nozzle communicating with the dust collector of the cleaner body, the intake nozzle moving along a floor to suck an air including the dust. And, the intake nozzle includes a nozzle case, a first air intake port provided to a bottom of the nozzle case to suck the air including the dust by an air intake force generated from driving an air intake device, and an intake force adjusting device varying an intake force of the first air intake port.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
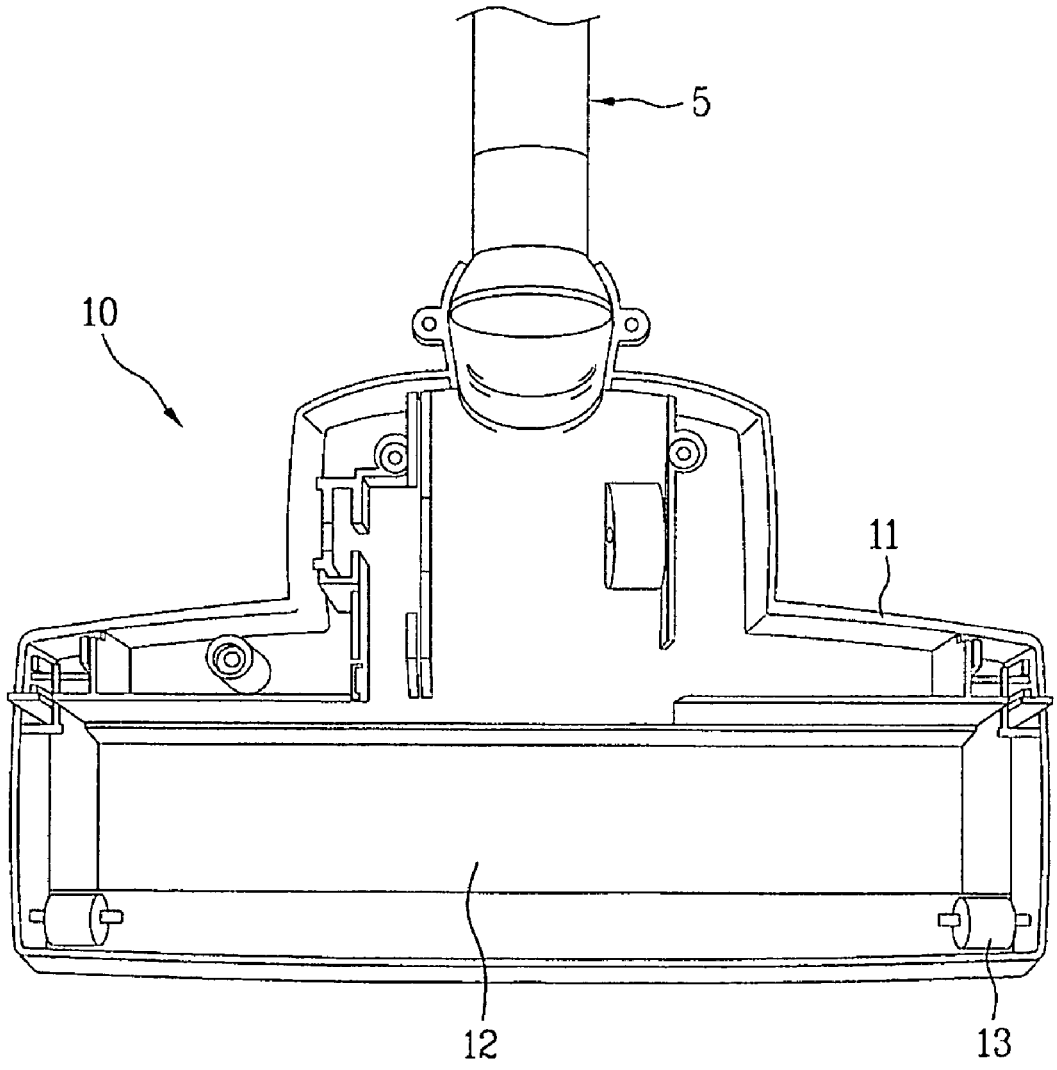
FIG. 1 Related Art
FIG. 1 is a perspective diagram of an intake nozzle of a vacuum cleaner according to a related art.
Figure 2:
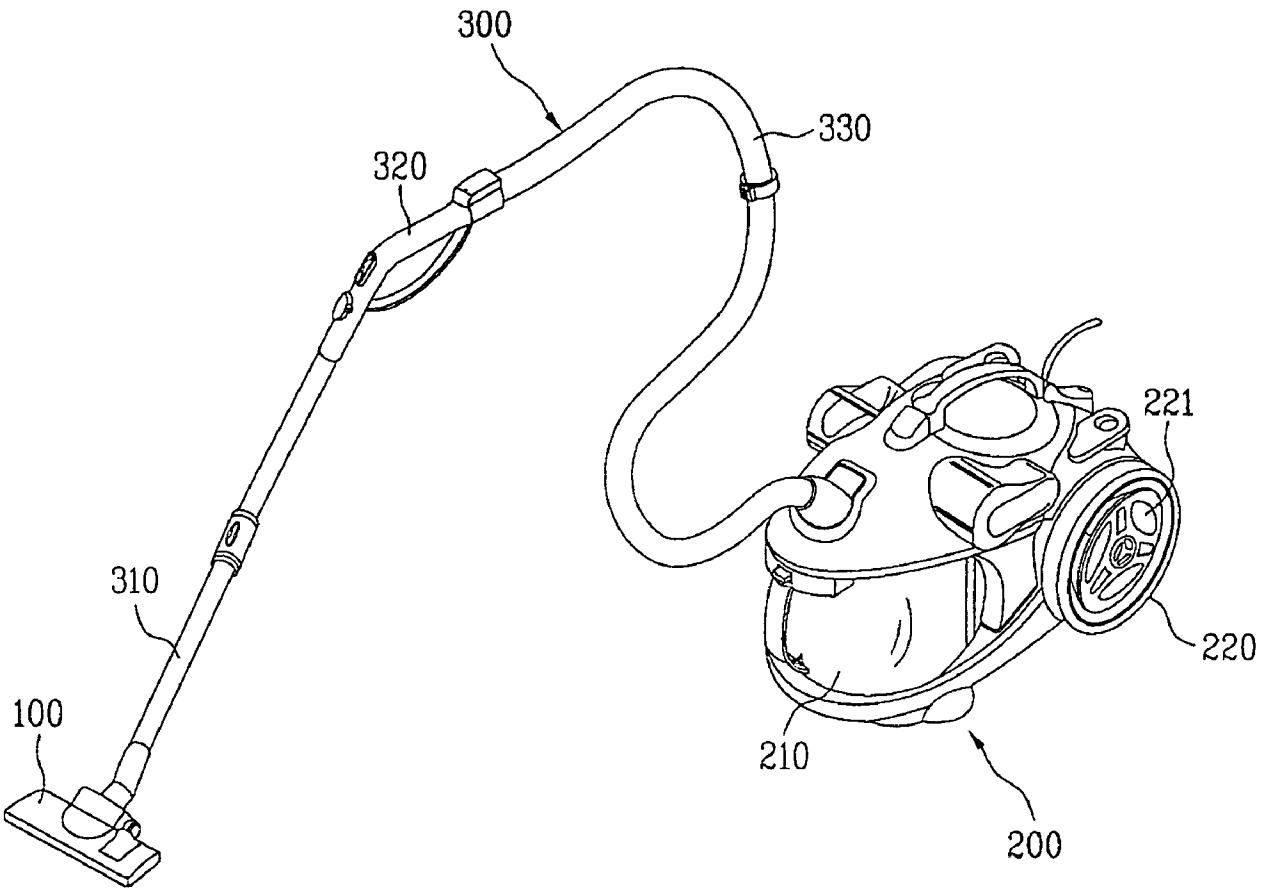
FIG. 2 is a perspective diagram of a vacuum cleaner having an intake nozzle according to the present invention.
Figure 3:
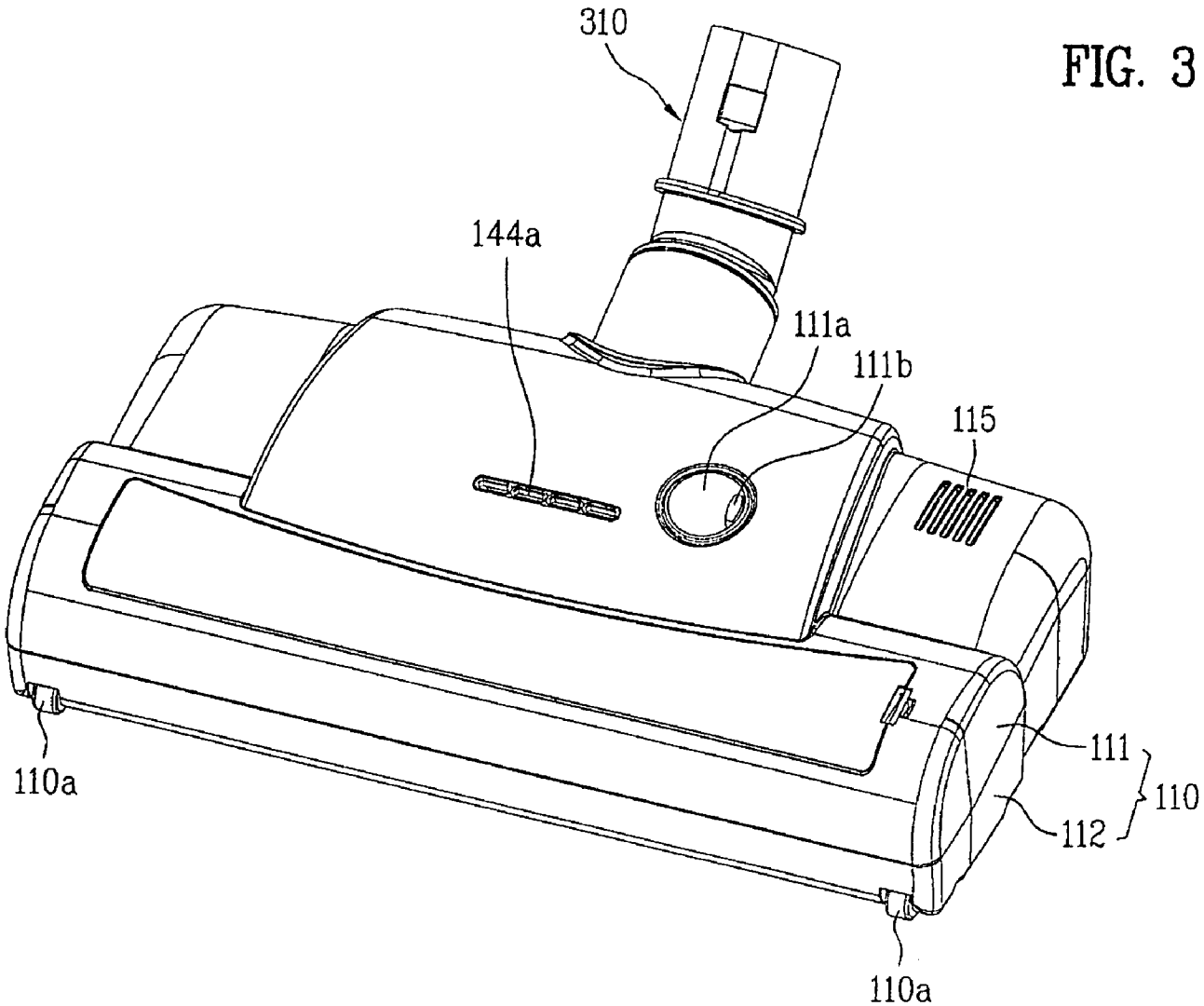
FIG. 3 is a perspective diagram of an intake nozzle according to one embodiment of the present invention.
Figure 4:
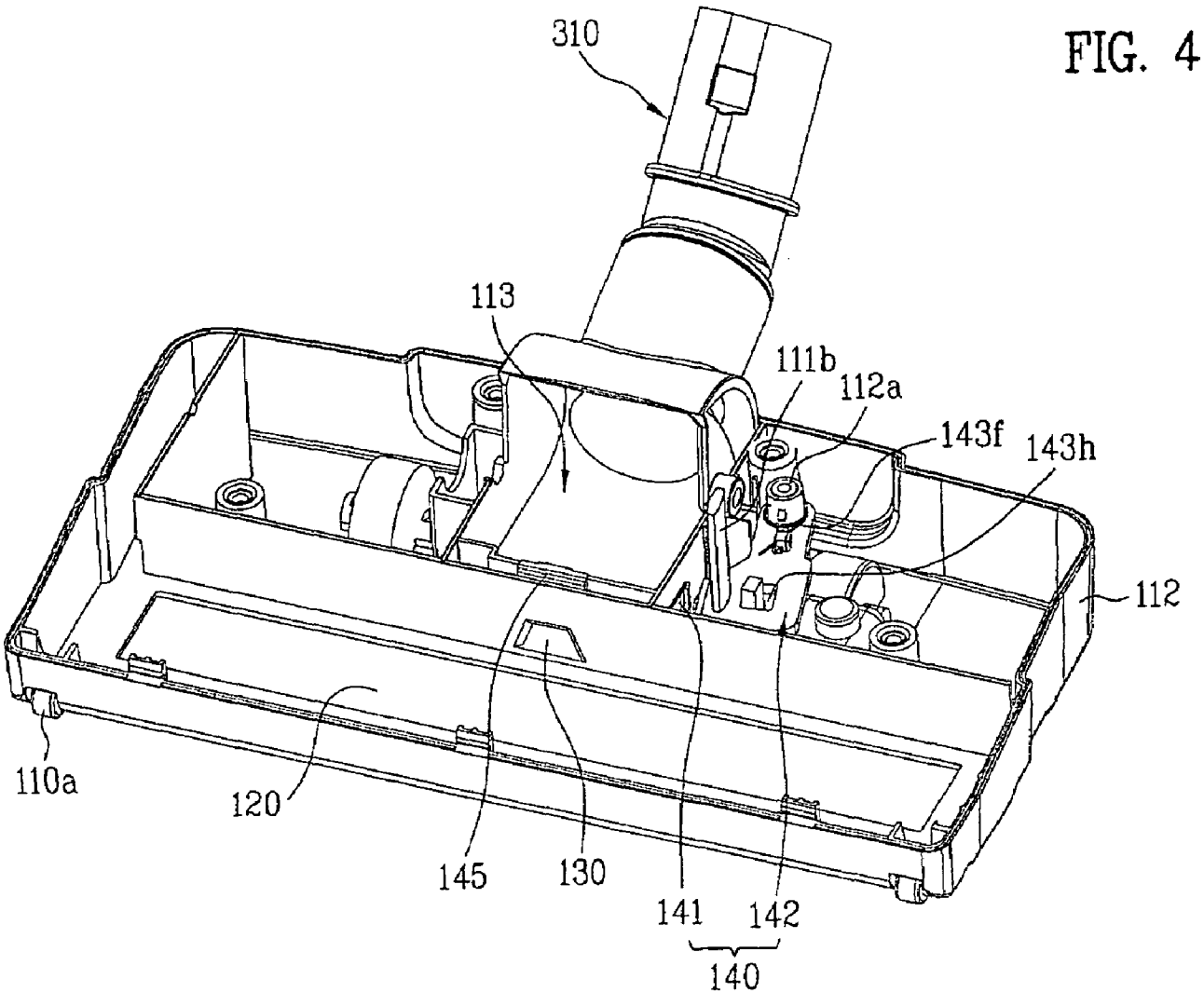
FIG. 4 is a perspective view of the intake nozzle shown in FIG. 3, with an upper case thereof removed.
Figure 5:
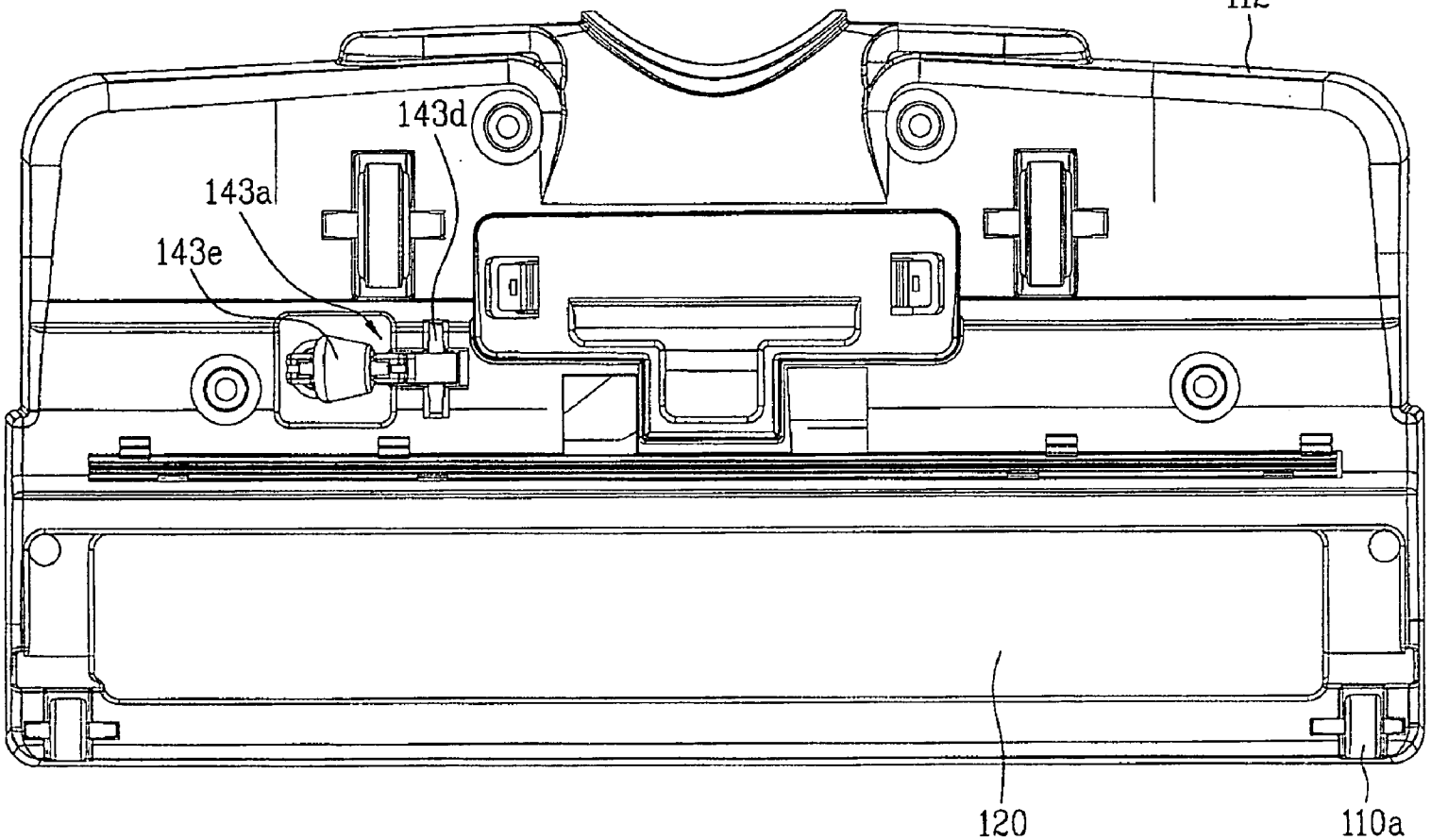
FIG. 5 is a bottom diagram of an intake nozzle according to the present invention.
Figure 6:
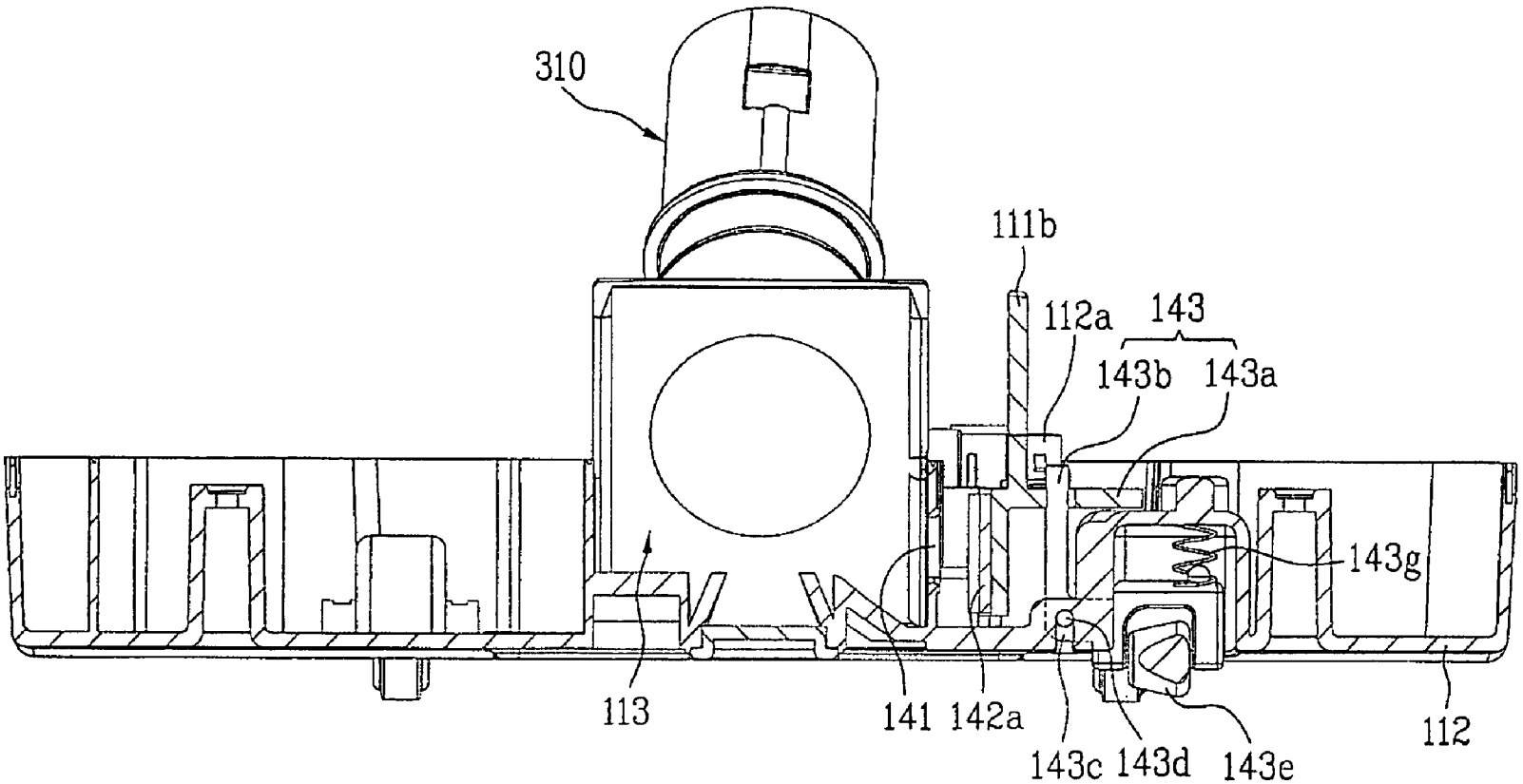
FIG. 6 is a cross-sectional diagram of the intake nozzle in FIG. 4 along a cutting line in right-to-left direction centering on a lever part.

Reference will now be made in detail to the preferred embodiments of the present invention, examples of which are illustrated in the accompanying drawings. Wherever possible, the same reference numbers will be used throughout the drawings to refer to the same or like parts.

First of all, vacuum cleaners are classified into a canister type vacuum cleaner and an upright type vacuum cleaner in general.

The canister type vacuum cleaner includes a cleaner body, an intake nozzle separated from the cleaner body, and a connecting pipe mutually connecting the cleaner body and the intake nozzle together.

And, the upright type vacuum cleaner includes an intake nozzle and a cleaner body joined to an upper part of the intake nozzle.

In the present embodiment, the canister type vacuum cleaner is described as a vacuum cleaner having an intake nozzle according to one embodiment of the present invention.

Referring to FIGS. 2 to 5, a vacuum cleaner having an intake nozzle according to one embodiment of the present invention includes an intake nozzle 100 moving along a floor to suck an air containing particles, a cleaner body 200, and a connecting pipe 300 mutually connecting the intake nozzle 100 and the cleaner body 200 together to guide a polluted air to the cleaner body 200.

Within the cleaner body 200 provided are an air intake device (not shown in the drawing) generating an air intake force and an electric/electronic unit (not shown in the drawing) to control the vacuum cleaner.

The air intake device includes a motor and a fan. Wheels 220 are rotatably provided to both sides of the cleaner body 200 to enable the cleaner body 200 to move on the floor smoothly, respectively. And, an exhaust portion 221 is provided to each of the wheels 220 to discharge an particle-removed air.

A dust collector 210 is detachably provided to a front side of the cleaner body 200 for the separation and storage of the particles such as dust and the like. And, a dust collector loading space is provided to the front side of the cleaner body 200 to accommodate the dust collector 210.

In this case, the particles such as dust and the like are introduced into the dust collector 210 to be collected by a cyclon system or a filtration system using a filter device.

Optionally, the dust collector 210 can collect dust using both of the cyclon system and the filtration system using the filter device.

The connecting pipe 300 includes a hard extension pipe 310 having one end connected to the intake nozzle 100, a flexible connecting hose 330 having one end connected to the other end of the extension pipe 310 and the other end connected to the cleaner body 200, and a handle 320 provided to a portion of the other end of the extension pipe 310.

A configuration of the intake nozzle 100 according to the present invention is explained with reference to FIGS. 3 to 8 as follows.

Referring to FIGS. 3 to 6, the intake nozzle 100 includes a nozzle case 110 forming an exterior, a first air intake port 120 provided to a bottom of the nozzle case 110, and an intake force adjusting device adjusting an air intake force of the first air intake port 120.

In this case, the nozzle case 110 includes an upper case 111 and a lower case 112 provided under the upper case 111. And, a prescribed space is provided within the nozzle case 110 to accommodate the intake force adjusting device and the Like.

And, moving wheels **110*a* are rotatably provided to both lower front sides and a lower rear part of the lower case 112, respectively to facilitate a movement of the intake nozzle 110**.

The first air intake port 120 is formed long in right-to-left direction to perforate a front part of the lower case 112. Hence, by the driven air intake device, external air is introduced into the nozzle case 110 together with the particles on the floor via the first air intake port 120 and is then introduced into the extension pipe 310 via an air passage provided within the nozzle case 110.

Meanwhile, the intake force adjusting device raises the air intake force of the first air intake port 120 if the nozzle case 110 of the intake nozzle is landed on the floor or lowers the air intake force of the first air intake port 120 if the nozzle case 110 is separated from the floor.

Alternatively, the intake force adjusting device can be configured to vary the air intake force of the first air intake port 120 according to a status of the floor on which the nozzle case 110 is landed. Namely, the air intake force of the first air intake port 120 varies according to a degree of pressurization applied to a bottom of the nozzle case 110 by the floor to be cleaned.

For this, the intake force adjusting device includes an air passage having an external air supply port 141 formed at the sidewall and a cut-off unit 142 adjusting an opening degree of the external air supply port 141.

In this case, the air introduced via the first air intake port 120 passes through the air passage.

In other words, the air passage guides the air introduced via the first air intake port 120 to the extension pipe 310.

In the present embodiment, the air passage includes a chamber 113 having a second air intake port 130 formed at a front side to communicate with the first air intake port 120 and the external air supply port 141 formed at a lateral side.

Hence, the chamber 113 is provided between the first air intake port 120 and the extension pipe 310. The air sucked via the first air intake port 120 is introduced into the chamber 113 via the second air intake port 130.

For this, a front wall of the chamber 113 extends in right-to-left direction to partition an internal space of the nozzle case 110 into front and rear spaces.

And, the cut-off unit 142 plays a role in adjusting a flux of the air passing through the first air intake port 120.

Namely, if the opening degree of the external supply port 141 is lowered, the air intake force is concentrated on the first air intake port 120 to increase the flux of the air introduced into the first air intake port 120.

On the contrary, if the opening degree of the external supply port 141 is raised, the air intake force is distributed to the first air intake port 120 and the external air supply port 141 to decrease the flux of the air introduced into the first air intake port 120 is increased.

In particular, the eternal air supply port 141 is formed by perforating a lateral side of the chamber 113 and an external air intake port 115 is formed at one side of the nozzle case 110 to communicate with the external air supply port 141.

In this case, the external air intake port 115 is preferably provided to a prescribed part of the nozzle case 110, and more particularly, to one side of a rear part of the upper case 111 so that the external air having been introduced into the rear space of the nozzle case 110 is introduced into the chamber 113 via the external air supply port 141.

In this case, the intake force adjusting device changes an intake force of the first air intake port 120 according to whether the nozzle case 110 is landed on the floor and/or according to a status of the floor.

And, the status of the floor means a surface state of the floor to be cleaned such as a hard floor, which includes a wooden floor, a laminated floor or the like, and a soft floor including a carpet, a bedding sheet or the like.

For this, the cut-off unit 142 includes a cut-off plate 142*a* opening or closing the external air supply port 141 and a lever unit 143 connected to the cut-off plate 142*a* to adjust the opening degree of the external air supply port 141.

The lever unit 143 adjusts the cut-off plate 142*a* in a manner of raising the intake force of the first air intake port 120 to increase the flux of the air sucked into the first air intake port 120 in case of being pressurized by the floor.

In particular, according to whether the nozzle case 110 is landed on the floor and/or according to the status of the floor on which the nozzle case 110 is landed, by adjusting the flux of the air sucked via the external air supply port 141, the flux of the air introduced into the chamber 113 via the first and second air intake ports 120 and 130 is adjusted.

In this case, a lower end of the external air supply port 141 is preferably spaced apart from a lower end of a lateral side of the chamber 113, and more particularly, from an upper side of the lower case 112 with a predetermined height in-between. And, a lower end of the cut-off plate 142*a* is preferably spaced apart from the upper side of the lower case 112 with a predetermined height.

This is to prevent an operational failure from being caused by the particles such as dust piled up on the upper side of the lower case 112 when the cut-off plate 142*a* is moving.

And, the lever unit 143 includes a first lever 143*a* and a second lever 143*b* connected to the first lever 143*a*.

In the present embodiment, the lever unit 143 moves the cut-off plate 142*a* toward the external air supply port 141 so that a flux of the air passing through the external air supply port 141 is reduced if the nozzle case 110 of the intake nozzle 100 is landed on the floor.

On the contrary, the lever unit 143 is configured to make the cut-off plate 142 return in a direction getting far away from the external air supply port 141 to raise the flux of the air passing through the external air supply port 141 if the nozzle case 110 is separated from the floor.

Hence, once the nozzle case 110 is landed on the floor, the intake force of the first air intake port 120 is increased. Once the nozzle case 110 is separated from the floor, the intake force of the first air intake port 120 is decreased.

In particular, one end of the first lever 143*a* is connected to the cut-off plate 142*a* and the other end of the first lever 143*a* is rotatably connected to a first rotational shaft 112*a* projected upward from an inside of the nozzle case 110, and more particularly, from a rear inside of the lower case 112.

One side of the second lever 143*b* is configured to pressurize the first lever 143*a*. And, the other side of the second lever 143*b*, which is configured to be projected from a lower part of the nozzle case 110, can be pressurized by the floor.

In the present embodiment, if the second lever 143*b* is pressed by the floor in a manner that the nozzle case 110 is landed on the floor, the second lever 143*b* turns the first lever 143*a* so that the cut-off plate 142*a* reduces the opening degree of the external air supply port 141.

Hence, to reduce the flux of the air introduced into the external air supply port 141 when the nozzle case 110 is landed on the floor, the second lever 143*b* moves the cut-off plate 142*a* connected to the first lever 143*a* toward the external air supply port 141.

Preferably, a prescribed part between both ends of the second lever 143*b* is rotatably connected to the lower case 112. More preferably, the prescribed part between both of the ends of the second lever 143*b* corresponds to a middle part of the second lever 143*b*.

Hence, if the other side of the second lever 143*b* projected from the lower side of the lower case 112 is pressed by the floor, the first lever 143*a* is turned by the second lever 143*b* so that the cut-off plate 142*a* is moved toward the external air supply port 141 to reduce the flux of the air introduced into the external air supply port 141.

For this, the second lever 143*b* is substantially bent to form a 'L' type bent portion 143*c* and is connected to the lower case 112 by a second rotational shaft 143*d* provided to the bent portion 143*c* to turn around the bent portion 143*c*.

Namely, one side of the second lever 143*b* is extended upward centering on the bent portion 143*c* and the other side of the second lever 143*b* is extended in a lateral direction centering on the bent portion 143*c* to be selectively pressurized by the floor to be cleaned. Thus, the second lever 143*b* is turned.

Moreover, a roller 143*e* is preferably provided to the other side of the second lever 143*b* to be brought: into contact with the floor. Hence, a friction between the second lever 143*b* and the floor is minimized.

And, the lower case 112 is preferably provided with a perforated hole penetrated by one side of the second lever 143*b* in a vertical direction and an accommodating recess to accommodate the other side of the second lever 143*b* that is pressed by the floor.

Besides, the first lever 143*a* is elastically supported by a first spring 143*f* that returns the cut-off plate 142*a* in a direction of opening the external air supply port 141.

Namely, once the force pressing the other side of the second lever 143*b* is released, the first spring 143*f* applies a restoring force to the first lever 143*a* to return the cut-off plate 142*a* so that the flux of the air introduced via the external air supply port 141 can be increased.

In this case, the first spring 143*f* may include a torsion spring provided to the first rotational shaft 112*a*.

Moreover, a second spring 143*g* is preferably provided to the lower case 112 to pressurize the second lever 143*b* so that the other side of the second lever 143*b* is projected from the lower side of the lower case 112.

In this case, the second spring 143*g* is accommodated in the accommodating recess accommodating the second lever 143*b* to pressurize a top of the other side of the second lever 143*b*.

A connecting hole 143*h* is provided to the first lever 143*a* for the connection between the first and second levers 143*a* and 143*b*. In this case, one side of the second lever 143*b* is fitted in the connecting hole 143*h*.

Meanwhile, while being pressed by a maximum force by the floor, the second lever 143*b* moves the cut-off plate 142*a* built in one body of the first lever 143*a* to a position in the vicinity of the external air supply port 141.

Once the cut-off plate 142*a* is moved to the position in the vicinity of the external air supply port 141, the cut-off plate 142*a* completely cuts off the external air supply port 141 by an intake force within the chamber 113.

For this, a thickness of one side of the second lever 143*b* is preferably smaller than a width of the connecting hole 143*h*.

Meanwhile, a display window 111*a* is provided to a topside of the nozzle case 110, i.e., a topside of the upper case 111 to check out the opening degree of the external air supply port 141.

In this case, the display window 111*a* is formed of a transparent material. And, a check piece 111*b* protruding in one body from the lever unit 143, and more particularly, from the first lever 143*a* is provided within the display window 111*a*.

Hence, if the check piece 111*b* fully lies down toward the external air supply port 141, it is informed that the external air supply portion 141 is cut off.

Besides, the intake nozzle 100 according to the present invention is preferably configured to prevent an overload of the motor in case that the air passage is blocked.

Figure 7:
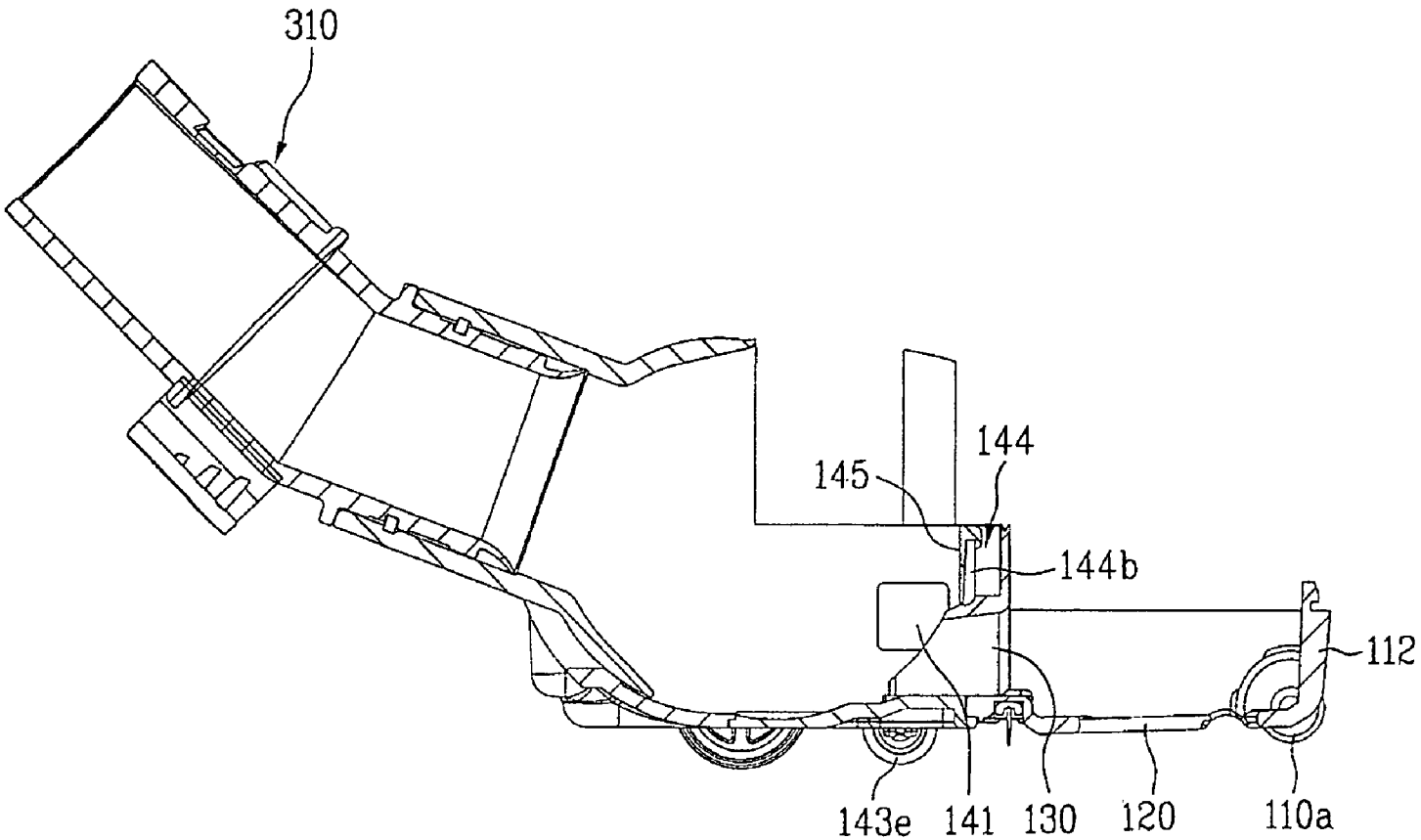
FIG. 7 is a cross-sectional diagram of the intake nozzle in FIG. 4 along a cutting line in front-to-rear direction.
Figure 8:
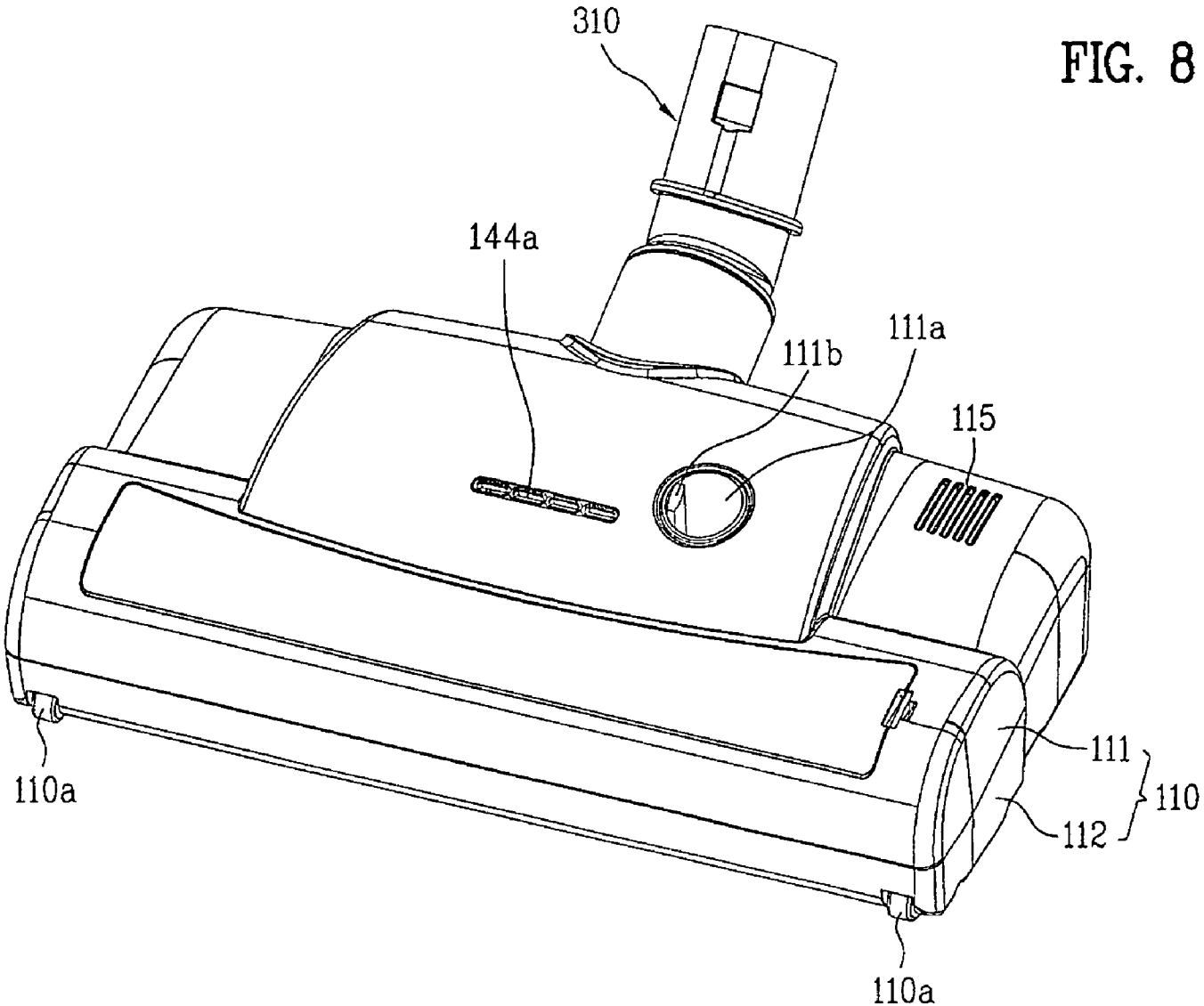
FIG. 8 is a perspective diagram of an intake nozzle of a vacuum cleaner according to the present invention, in which the intake nozzle shows a maximum sucking force.

Referring to FIG. 7, the nozzle case 110 is provided with an auxiliary air passage 144 guiding the external air into the chamber 113 selectively to prevent the internal passage from being blocked and a passage opening/closing portion 145 selectively opening/closing the auxiliary air passage 144.

In this case, the auxiliary air passage 144 includes an auxiliary air intake port 144*a* formed on a center of a topside of the upper case 111 and an auxiliary air supply port 144*b* provided over the second air intake port 150 to supply the external air to the inside of the chamber 113.

In the present embodiment, the passage opening/closing portion 145 is opened/closed by a difference between an atmospheric pressure outside the nozzle case and an internal pressure within the chamber 113.

In particular, the passage opening/closing portion 145 may include an elastic member.

In this case, one side of the elastic member is preferably connected to a prescribed position of the auxiliary air passage 144, and more particularly, to an upper end of the auxiliary air supply port 144*b* and the other side of the elastic member is preferably supported by a rim of the auxiliary air supply port 144*b* to be bent toward an inside of the chamber 113.

In this case, as an elastic coefficient of the passage opening/closing portion 145 is lowered, the passage opening/closing portion 145 can be opened more easily. If the elastic coefficient of the passage opening/closing portion 145 is raised higher, the passage opening/closing portion 145 can be opened in case of a high vacuum state within the chamber only.

Hence, the material of the passage opening/closing portion 145 needs to be appropriately selected according to performance of the moor, a cross-sectional area of the auxiliary air passage and the like.

By the above configuration of the vacuum cleaner, in cleaning a floor of covered with a carpet, the roller 143*e* of the second lever 143*b* is pressed by the carpet so that the external air supply port 141 is cut off by the cut-off plate 142*a*. If so, the intake force of the first air intake port 120 is maximized.

Moreover, if the inside of the chamber 113 becomes in high vacuum state because of the first air intake port 120 blocked by the carpet, the passage opening/closing portion 145 is bent toward the inside of the chamber 113 to open the auxiliary air supply port 144*b*.

Hence, the external air is introduced into the chamber 113 to prevent the motor overload or noise.

An operation of the vacuum cleaner having the above-configured intake nozzle 100 according to the present invention is explained as follows.

First of all, once external power is applied to the vacuum chamber, the motor and fan provided within the cleaner body are rotated to generate the air intake force. And, external air can be introduced into the intake nozzle 100 by the air intake force.

In doing so, if the intake nozzle 100 lies in a state of being separated from the floor to be cleaned, the air introduced via the first air intake port 120 and the external air intake port 115 passes through the second air intake port 150 and the external air supply port 141., respectively so that the intake force of the first air intake port 120 is minimized.

Subsequently, once the intake nozzle 100 is landed on the floor to be cleaned, the roller 143*e* of the second lever 143*b* is pressed by the floor to be turned upward centering on the bent portion 143*c* of the second lever 143*b*.

As one side of the second lever 143*b* extending upward centering on the bent portion 143*c* turns the first lever 143*a* toward the external air supply port 141, the cut-off plate 143 reduces the opening degree of the external air supply port 141 to concentrate the air intake force on the first air intake port 120.

Accordingly, the air intake force of the first air intake port 120 is raised to enhance the performance of sucking dust.

Thus, the polluted air introduced via the first air intake port 120 is passed through the chamber 113, is guided to the dust collector 210 of the cleaner body via the connecting pipe 300, and is then discharged outside via the blowing portion 221 of the wheel. In doing so, the particles of the polluted air are removed by the dust collector 210.

In this case, the air intake force of the first air intake port 120 reaches its maximum level if the external air supply port 141 is completely cut off.

Meanwhile, in cleaning the carpet floor with the vacuum cleaner, if the external air supply port 141 is cut off by the cut-off plate 142*a* and if the first air intake port 120 is blocked by the carpet, the flux of the air introduced into the chamber 113 is reduced.

If an internal pressure of the chamber 113 becomes equal to or smaller than a prescribed pressure, the passage opening/closing portion 145 of the auxiliary air passage 144 is opened to guide the external air to the inside of the chamber 113.

And, in case of separating the intake nozzle from the floor to clean another place, the external air supply port 141 is fully opened to distribute the air intake force to the external air supply port 141 and the first air intake port 120.

Hence, the intake force of the first air intake port 120 and the noise of the intake nozzle are reduced.

Accordingly, the present invention provides the following effects or advantages.

First of all, as the dust intake force of the intake nozzle is variable, the vacuum cleaner is facilitated to use.

Secondly, if the intake nozzle is landed on the floor, the air intake force of the intake nozzle is increased. If the intake nozzle is separated from the floor, the air intake force of the intake nozzle is decreased. And, the air intake force of the intake nozzle is varied according to the status of the floor on which the intake nozzle is landed. Hence, the present invention enhances the performance of sucking particles.

Thirdly, if the intake nozzle is separated from the floor, the air intake force of the intake nozzle is lowered to reduce the flux and current speed of the air introduced into the first air intake port. Hence, the intake noise of the air is reduced.

Finally, if the intake nozzle is separated from the floor to carry the vacuum cleaner, the air intake force of the intake nozzle is reduced. Hence, when a user holds the intake nozzle to carry move to another place to be cleaned, the present invention prevents a user's clothes, a curtain and the like from being sucked into the intake nozzle.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An intake nozzle of a vacuum cleaner, comprising:

a nozzle case having a main air passage that extends therethrough;

a first air intake port provided at a bottom of the nozzle case, at an inlet end of the main air passage, wherein an air intake force generated by an air intake device draws particle laden air in through the first air intake port and into the main air passage; and an intake force adjusting device that varies an amount of intake force conveyed through the first intake port based on a contacting surface of a surface to be cleaned, wherein the intake force adjusting device comprises a separate chamber provided in the main air passage formed in the nozzle case;

an auxiliary air passage formed in a first side wall of the chamber, wherein the auxiliary air passage guides external air into the chamber;

a second air intake port formed in a second side wall of the chamber, wherein the second air intake port receives air from the first air intake port; and an opening/closing portion that selectively opens the auxiliary air passage based on a difference between a pressure within the chamber and an atmospheric pressure outside the nozzle case so as to prevent blockage in the chamber.

2. The intake nozzle of claim 1, wherein the intake force adjusting device increases the amount of intake force conveyed through the first air intake port if the nozzle case is positioned on a surface to be cleaned, and wherein the intake force adjusting device decreases the amount of intake force conveyed through the first air intake port if the nozzle case is separated from the surface to be cleaned.

3. The intake nozzle of claim 2, wherein the chamber includes an external air supply port formed at a sidewall of the chamber such that external air introduced through an opening in a side of the nozzle case is introduced into the chamber via the external air supply port, and wherein the intake force adjusting device further comprises a cut-off unit that adjusts an opening degree of the external air supply port so as to adjust a flow rate of air passing through the first air intake port.

4. The intake nozzle of claim 3, the cut-off unit comprising:

a cut-off plate that selectively opens and closes the external air supply port; and a lever unit connected to the cut-off plate so as to adjust a position of the cut-off plate, wherein the lever unit increases an air flow rate through the first air intake port in response to pressure applied to the lever unit by the surface to be cleaned.

5. The intake nozzle of claim 4, the lever unit comprising:

a first lever having a first end connected to the cut-off plate and a second end rotatably connected to a rotational shaft provided within the nozzle case; and a second lever having a first end configured to selectively apply a force to the first lever and a second end that projects outward beneath the nozzle case and is configured to be selectively pressed by the surface to be cleaned based on a position of the nozzle case relative to the surface to be cleaned.

6. The intake nozzle of claim 5, wherein the first lever is elastically supported in the nozzle case by a first spring and wherein the first spring is biased so as to return the cut-off plate to a position in which the external air supply port is open.

7. The intake nozzle of claim 5, wherein the second lever is rotatably connected to a lower part of the nozzle case at a position between its first and second ends.

8. The intake nozzle of claim 7, further comprising a display window provided at an upper surface of the nozzle case, wherein the display window provides an indication of a position of the cut off plate relative to the external air supply port.

9. The intake nozzle of claim 5, wherein the first lever moves the cut-off plate toward the external air supply port in response to rotation of the second lever due to pressure from the surface to be cleaned and subsequent application of force on the first lever having the cut-off plate connected thereto.

10. The intake nozzle of claim 1, wherein the opening/closing portion comprises an elastic member that is opened/closed by a difference between a pressure within the chamber and an atmospheric pressure outside the nozzle case.

11. A vacuum cleaner, comprising:

a cleaner body provided with a dust collector that separates and collects dust therein; and an intake nozzle that communicates with the dust collector, wherein the intake nozzle draws in air including dust from a surface to be cleaned, the intake nozzle comprising:

a nozzle case having a main air passage formed therein;

a first air intake port provided at a bottom of the nozzle case, at an inlet into the main air passage, wherein an air intake force generated by an air intake device draws air and dust into the main air passage through the first air intake port; and an intake force adjusting device that varies an amount of intake force conveyed through the first air intake port, wherein the intake force adjusting device comprises:

a separate chamber provided in the main air passage formed in the nozzle case;

an auxiliary air passage formed in a first side wall of the chamber, wherein the auxiliary air passage guides external air into the chamber;

a second air intake port formed in a second side wall of the chamber, wherein the second air intake port receives air from the first air intake port; and an opening/closing portion that selectively opens the auxiliary air passage based on a difference between a pressure within the chamber and an atmospheric pressure outside the nozzle case so as to prevent blockage in the chamber.

12. The vacuum cleaner of claim 11, wherein the chamber includes an external air supply port formed at a sidewall of the chamber such that external air introduced through an opening in a side of the nozzle case is introduced into the chamber via the external air supply port, and wherein the intake force adjusting device further comprises a cut-off unit that adjusts an opening degree of the external air supply port to adjust an airflow rate through the first air intake port.

13. The vacuum cleaner of claim 12, the cut-off unit comprising:

a cut-off plate that selectively opens and closes the external air supply port; and a lever unit connected to the cut-off plate so as to adjust a position of the cut-off plate, wherein the lever unit increases an air flow rate through the first air intake port in response to pressure applied to the lever unit by the surface to be cleaned.

14. The vacuum cleaner of claim 13, the lever unit comprising:

a first lever having a first end connected to the cut-off plate and a second end rotatably connected to a rotational shaft provided within the nozzle case;

a second lever having a first end configured to selectively apply a force to the first lever and a second end that projects outward beneath the nozzle and is configured to be selectively pressed by the surface to be cleaned; and a first spring that elastically supports the first lever so as to return the cut-off plate to a position in which the external air supply port is open.

15. The vacuum cleaner of claim 14, wherein the first lever moves the cut-off plate toward the external supply port so as to completely cover the external air supply port in response to rotation of the second lever due to pressure applied to the second lever by the surface to be cleaned and subsequent application of force on the first lever having the cut-off plate connected thereto.

16. The vacuum cleaner of claim 11, wherein the opening/closing portion comprises an elastic member that is opened/closed by a difference between a pressure within the chamber and an atmospheric pressure outside the nozzle case.

17. A vacuum cleaner, comprising:

a main body including a dust collection assembly; and a suction nozzle that is operably coupled to the dust collection assembly, wherein the suction nozzle comprises:

a housing having a main passage formed therein;

a first intake port provided at a bottom of the housing, at an inlet into the main passage;

a suction source that generates a suction force that draws particle laden air into the main passage through the first intake port; and a suction force adjusting device that adjusts a level of suction force conveyed through the first intake port, wherein the suction force adjusting device comprises:

a separate chamber formed within the main passage;

an auxiliary passage formed in a first side wall of the chamber;

a second intake port formed in a second side wall of the chamber, wherein the second intake port receives particle laden air from the first air intake port and conveys it into the chamber; and a cover movably coupled to the housing so as to selectively cover the auxiliary passage based on a difference between a pressure within the chamber and an external pressure.

18. The vacuum cleaner of claim 17, further comprising a lever assembly that movably couples the cover to the housing, wherein the lever assembly comprises:

a first lever having a first end thereof coupled to the cover and a second end thereof rotatably coupled to the housing; and a second lever having a first end that extends out through a bottom of the housing, central portion thereof rotatably coupled to the housing, and a second end that applies a force to the first lever in response to contact between the first end of the second lever and a surface to be cleaned.

19. The vacuum cleaner of claim 18, wherein, when the first end of the second lever is depressed by contact with the surface to be cleaned, the second end of the second lever applies a force to the first lever that moves the cover toward the auxiliary passage.

20. The vacuum cleaner of claim 19, wherein the intake force conveyed through the first intake port when the cover covers the auxiliary passage is greater than the intake force conveyed through the first intake port when the cover is spaced apart from the auxiliary passage.

* * * * *